US005283471A

United States Patent [19]

Raad

[11] Patent Number: 5,283,471

[45] Date of Patent: Feb. 1, 1994

[54] DC GENERATOR AND BACK-UP ENGINE STARTING APPARATUS

[75] Inventor: Bernard A. Raad, Burbank, Calif.

[73] Assignee: Eemco/Datron, Inc., Los Angeles, Calif.

[21] Appl. No.: 938,429

[22] Filed: Aug. 31, 1992

[51] Int. Cl.[5] ..... F02N 11/04; F02N 11/00

[52] U.S. Cl. ..... 290/46; 290/31

[58] Field of Search ..... 290/31, 46

[56] References Cited

U.S. PATENT DOCUMENTS

| | | | |
|---|---|---|---|
| 4,743,776 | 5/1988 | Baehler et al. | 290/31 |
| 4,743,777 | 5/1988 | Shilling et al. | 290/46 |
| 4,830,412 | 5/1989 | Raad | 290/31 |
| 5,055,700 | 10/1991 | Dhyanchand | 290/31 |

*Primary Examiner*—A. D. Pellinen
*Assistant Examiner*—Robert Lloyd Hoover
*Attorney, Agent, or Firm*—Trexler, Bushnell, Giangiorgi & Blackstone, Ltd.

[57] ABSTRACT

A dynamoelectric device operable as a generator for generating electricity and as a starter motor for starting an associated primary engine in a vehicle. The generator provides 270 Volt DC power during a generating mode while the primary engine is operating and may be used to restart the primary engine in the event that the primary engine is disabled. The dynamoelectric apparatus includes a main generator having a main generator field and a main generator armature. An exciter generator is included which has an exciter armature and an exciter generator field. A rectifier assembly is coupled between the exciter armature and the main generator field. A field shorting switch is coupled to the rectifier assembly and the main generator field for selectively coupling and uncoupling the rectifier assembly during a start-up mode to protect the rectifier assembly against high voltages and voltage spikes. A device for motorizing the primary generator to function as an induction motor includes a secondary engine, a power and current limited auxiliary power unit generator operated by the secondary engine and a starter contactor coupled to the auxiliary power unit generator and the main generator field. The starter contactor selectively couples and uncouples the auxiliary power unit generator and the main generator field for motorizing the main generator to function as an induction motor. The present invention transforms a 270 Volt DC generator driven by the primary engine into a starter motor to start the primary engine by combining it with the secondary engine and the associated auxiliary power unit generator by way of a few relatively simple modifications.

4 Claims, 1 Drawing Sheet

FIG. 1
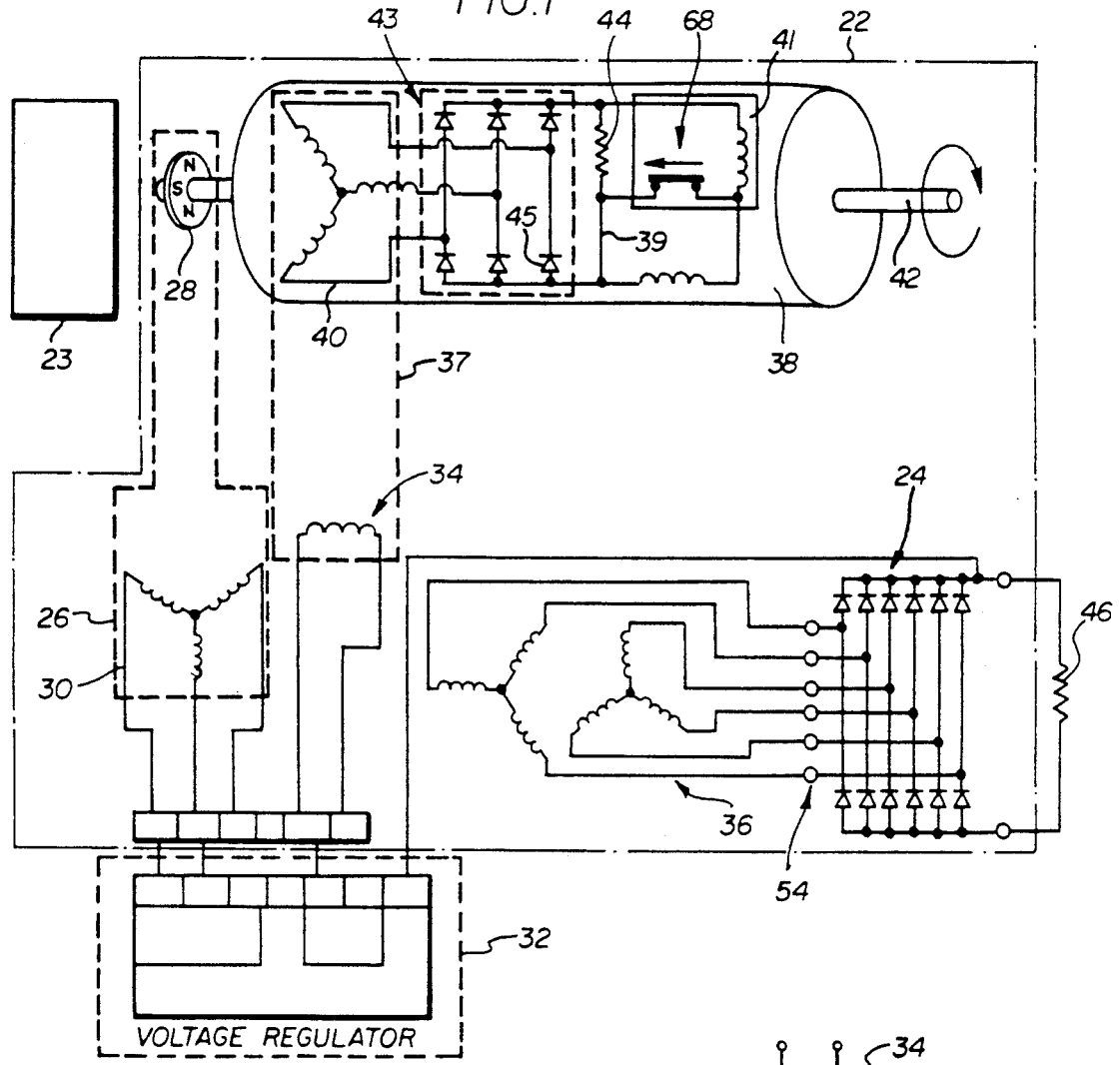
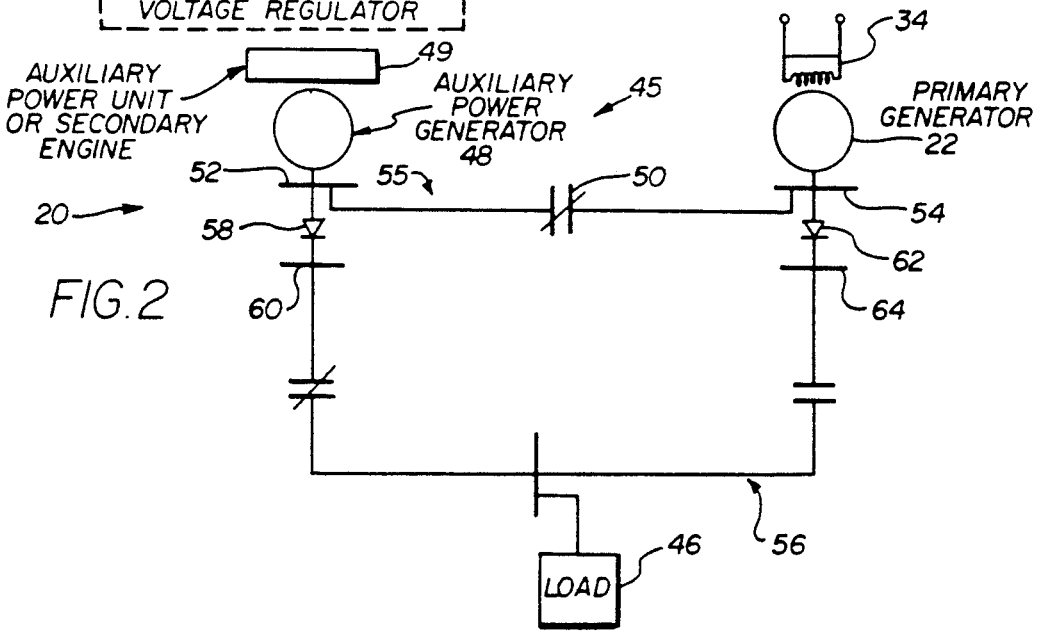
FIG. 2

DC GENERATOR AND BACK-UP ENGINE STARTING APPARATUS

BACKGROUND OF THE INVENTION

A variety of vehicles, whether airborne or land-based, include a primary power plant or engine which is operated under a variable speed regime and capable of generating upwards of 1500 h.p. Many of the vehicles also have a much smaller secondary power plant or engine which is operated to generate electrical power to operate systems when the primary engine is shut down (i.e. in order to save fuel, "run silently", or prevent detection). Such a secondary engine may only produce 100 h.p.

Many of the electrical systems used in such vehicles require constant frequency electrical power. In order to provide such electrical power, generators have been included with such primary engines in the form of either a constant speed drive (CSD) or a variable speed constant frequency (VSCF) converter. The constant speed drive regulates the speed at which a primary engine-driven AC generator is rotated and thus delivers constant frequency. The variable speed constant frequency converter regulates the frequency that a generator delivers while being rotated at variable speeds by the primary engine. These speed or frequency conversion devices are relatively expensive and reduce the overall efficiency and reliability of the generating system.

In order to eliminate the above devices and desensitize the system from the effects of frequency, other vehicle systems implement high voltage DC power for operation. Such devices are more frequently found in state-of-the-art vehicles such as high technology aircraft and land-based vehicles such as tanks. Some of these vehicles further require that the generator used to generate the high voltage DC power (typically 270 Volts DC) should be capable of starting the primary engine as a back-up feature. In other words, once the primary engine is started, it runs the generator to satisfy the power requirements. Additionally, when necessary, the generator can be employed as a starter motor to restart the primary engine.

One way to satisfy the operating requirements for such applications is to provide a second 270 Volt DC generator, mounted on and driven by an auxiliary power unit (APU) which is carried on the vehicle for running the generator as a starter motor. A problem arises in that in order to motorize the salient-pole brushless DC generator from the available 270 Volt DC power, a complex inverter is needed, which defeats the purpose of adapting the 270 Volt DC power.

For example, a device as shown in U.S. Pat. No. 4,743,776 to Baehler et al. issued May 10, 1988 shows a device which attempts to overcome the aforementioned problems. However, the device in Baehler et al. is highly complex requiring a torque converter, two overrunning clutches, a field shorting switch and a torque converter pump. Such complexities create dramatic inefficiencies in the system, additional failure points, added costs, as well as substantial increases in added space and weight. It should be noted that the space and weight factors are extremely important in high technology vehicles such as aircraft and tanks since these factors have a critical effect on payload, mission range, and speed.

Two devices as shown in U.S. Pat. No. 4,743,777 to Shilling et al. issued May 10, 1988 and U.S. Pat. No. 5,055,700 to Dhyanchand issued Oct. 8, 1991 include the complexities as discussed above with reference to Baehler et al. as well as variable voltage, variable frequency inverters. More specifically, Shilling et al. is highly complex including dual exciter windings, a rotor position sensor, complex microprocessor logic devices, as well as the converter/inverter mentioned hereinabove. The device as shown in Dhyanchand uses a variable voltage, variable frequency inverter which results in a reduction in the efficiency of the operation of the device. Further, the field shorting switch as shown in Dhyanchand requires a deliberate action in order to actuate the switch. Additionally, Dhyanchand uses an additional squirrel-cage circuit which clearly requires additional elements, space, and weight.

The problem of electrically starting the primary engine by using the engine-mounted main generator as a starter motor has been addressed by various means with varying levels of success as discussed hereinabove. When dealing with available DC power and a brushless DC generator, one solution is to motorize the device like a brushless DC motor. This starting method, however, has not been considered to be the best solution because it was thought to require extensive modifications in the engine-mounted generator. Also, such a system was thought to require use of inverters and other power conversion devices. Use of these additional devices would appear to defeat the purpose of using a 270 Volt DC power system because one of the advantages of implementing such a power system is to eliminate inverters and other power conversion devices.

OBJECTS AND SUMMARY OF THE INVENTION

A general object of the present invention is to provide a dynamoelectric device which performs as a generator when driven by an associated primary engine as well as an electric starter motor to start the associated primary engine.

Another object of the present invention is to minimize the overall size and weight of a dynamoelectric device which operates as a generator coupled with a primary engine and as an electric starter motor for starting the primary engine.

A more specific object of the present invention is to provide a dynamoelectric device which operates as a generator and as a starter motor, in a simplified manner, without using inverters, other drive motors or power conditioning devices.

Briefly and in accordance with the foregoing, the present invention includes a dynamoelectric device which operates as a generator and as a starter motor for starting an associated primary engine in a vehicle. The generator provides 270 Volt DC power while the primary engine is operating and may be used to restart the primary engine in the event that the primary engine is disabled or turned off. The dynamoelectric apparatus includes a primary generator having a main generator field and a main generator armature. An exciter generator is included which has an exciter armature and an exciter generator field. A rectifier assembly is coupled to the exciter armature and the main generator field. A field shorting switch is coupled to the rectifier assembly and the main generator field for selectively coupling and uncoupling the rectifier assembly during a start-up cycle to protect the rectifier assembly against high voltages and voltage spikes created when line starting the primary engine. A device for motorizing the primary generator to function as an induction motor includes a secondary engine, an auxiliary power unit generator associated with the secondary engine, and a starter contactor coupled to the auxiliary power unit generator and the main generator field. The present invention transforms a 270 Volt DC generator driven by the primary engine into a starter motor to start the primary engine with a few rather simple modifications.

BRIEF DESCRIPTION OF THE DRAWINGS

The organization and manner of the structure and operation of the invention, together with the further objects and advantages thereof, may be understood by reference to the following description taken in connection with the accompanying drawings, wherein like reference numerals identify like elements, and in which:

FIG. 1 is an electrical schematic representation of an dynamoelectric device or brushless DC generator/induction starter of the present invention; and FIG. 2 is a one-line diagram of the starting circuit of the present invention.

DETAILED DESCRIPTION OF THE ILLUSTRATED EMBODIMENT

While the invention may be susceptible to embodiment in different forms, there is shown in the drawings, and herein will be described in detail, an embodiment with the understanding that the present disclosure is to be considered an exemplification of the principles of the invention and is not intended to limit the invention to the embodiment as illustrated and described herein.

Referring now to the drawings, wherein like parts are designated by the same reference numerals throughout the figures, a dynamoelectric apparatus 20 in accordance with the present invention is shown in FIG. 2. FIG. 1 provides a diagrammatic schematic of a synchronous generator or primary generator 22 employed in the dynamoelectric apparatus 20.

The primary generator 22 is a three-in-one brushless generator which is coupled with a primary engine 23 for generating electricity. The primary generator 22 generates alternating current (AC) but also is capable of generating direct current (DC) when the output from the generator is led through a rectifier assembly 24. Initially, the primary generator 22 is rotated by the primary engine 23 to begin electrical power generation at the permanent magnet generator (PMG) 26. The field of the PMG 26 is permanently set up by the permanently magnetized rotor or PMG rotor 28. Lines of flux emanating from the PMG rotor 28 intersect the conductors in the PMG armature 30 to generate three-phase AC power. The PMG 26 is included within the primary generator 22 to achieve self-excitation even while the output from the main generator is short circuited.

A voltage regulator 32 in the form of a generally available component of known design is employed to rectify the three-phase AC power generated by the PMG 26 to produce DC and meter it back to an exciter generator field 34 according to the voltage sensed at the terminals of a main armature 36. A negative feedback loop is thus created to ensure that the primary generator 22 voltage is maintained within a certain band regardless of the generator speed and loading.

The brushless exciter 37 excites the main field 38. The magnetic field 34 of the exciter 37 is stationary and is erected by powering its windings electrically from the PMG 26 via the voltage regulator 32. A three-phase AC exciter armature 40 is positioned on a rotating shaft 42 of the primary generator 22. Power is generated when the conductors of the armature 40 traverse the magnetic field set up in the stator.

Because the main field 38 of the primary generator 22 requires DC to excite it, a diode assembly 43 is provided in close proximity to the exciter armature 40 to rectify the output of the exciter armature 40 and deliver the output to the main field 38. Although a full wave configuration is depicted in FIG. 1, it should be understood that the arrangement would work to a certain extent with a half wave configuration.

A shunting resistor 44 is connected across the diode assembly 43 to protect the diodes 45 from voltage spikes produced when the highly inductive main field 38 is suddenly de-energized. Another function of the shunting resistor 44 is to shorten the inductance/resistance (L/R) time constant of the field during overvoltage transient conditions.

Power used by a load 46 on the primary generator 22, such as electrical telecommunications equipment, sensors, and life support systems, is generated by the primary generator 22. In a similar fashion to the exciter 37, the rotating magnetic field is erected and intersects the conductors in the stationary AC main armature 36. The AC main armature 36 as shown in FIG. 1 is wound with two groups of three phases, wye-connected and rectified to DC by rectifiers 24. The two groups of three phases are used to reduce the DC distortion (ripple) when AC power is rectified to DC. It should be understood, however, that the main armature 36 can also be wound with other combinations of phases and phase groups.

Since the primary generator 22 is provided with a wound field exciter 37, it must be energized with DC so that it can form rotor magnetic poles. The wound field exciter 37 of the present invention should be contrasted with the permanent magnetic field found in most brushless DC motors. Such permanent magnet exciters rely on the attraction between unlike poles in the stator and the rotor to achieve rotary motion. In a start mode, because the rotor is stationary, the main field cannot be energized by the permanent magnet field exciter. In the generate mode, the primary engine 23 is operated to produce mechanical power to operate the vehicle. The primary engine 23 also produces shaft mechanical power which is converted to DC to energize the main field by energizing the exciter field and allowing the conductors in the exciter armature to traverse it.

When the primary engine 23 must be started, the main field cannot be energized as it is during the generate mode since the shaft is stationary and is not producing shaft mechanical power to convert to DC. Therefore, the power requirements of the main field during the start mode must be supplied by transformer action between the exciter stator and its rotor. The exciter stator and its rotor require AC to operate as a transformer primary and transfer power to energize the main field across the air gap to the exciter rotor acting as the secondary winding of the transformer.

Referring now to FIG. 2, the dynamoelectric apparatus 20 is shown in a simplified diagrammatic form. Means 45 for starting the primary engine 23 or starting means 45 includes an auxiliary power unit generator 48, an auxiliary power unit or secondary engine 49, and a start contactor 50 coupled to the auxiliary power unit generator 48 and the primary generator 22. The starting means 45 start contactor 50 controllably couples the primary generator 22 to the auxiliary power unit generator 48 to start the primary engine 23. The auxiliary power unit generator 48 features a first AC terminal block 52 which is coupled to the start contactor 50. Similarly, the primary generator 22 features a second AC terminal block 54 which is coupled to the start contactor 50. As such, the start contactor 50 can be enabled or disabled to complete an AC circuit 55 between the auxiliary power unit generator 48 and the primary generator 22. The auxiliary power unit generator 48 is coupled to an auxiliary power unit or secondary engine 49. The secondary engine 49 is much smaller than the primary engine 23 and may produce upwards of 100 h.p. compared to the primary engine 23 which may produce upwards of 1500 h.p. As such, the reduced power of the secondary engine 49 relative to the primary engine provides a power limiter on the output of the auxiliary power unit generator 48.

When the start contactor 50 is enabled, the AC circuit 55 between the auxiliary power unit generator 48 and the primary generator 22 is completed. The auxiliary power unit generator 48 provides alternating current to the main generator 22 through the AC circuit which is completed when the start contactor 50 is enabled. When the start contactor 50 is disabled, or open, a DC circuit 56 may be enabled between the auxiliary power unit generator 48 and the primary generator 22 and the AC circuit 55 is disabled. The DC circuit 56 includes a first diode assembly 58 positioned between the first AC terminal block 52 and a first DC terminal block 60 for rectifying the AC power into DC. Similarly, a second diode assembly 62 is positioned between the second AC terminal block 54 and a second DC terminal block 64 for rectifying the AC power to DC. As such, when the start contactor 50 is disabled, or opened, the load, in this case the primary generator 22, receives DC power to supply the power requirements to the main field.

As can be seen from FIGS. 1 and 2, the present invention does not require an exciter inverter, a brushless DC motor drive, and requires only one start contactor 50 to couple the auxiliary power unit generator 48 to the primary generator 22. Connections between the synchronous primary generator 22 and the auxiliary power unit generator 48 are made on the AC side of the main armature 36 resulting in the primary generator 22 being motorized like a squirrel-cage motor by inductive action on its amortisseur bars during the start-up mode.

An apparent drawback to starting the primary engine 23 by motorizing the primary generator 22 as an induction motor, by placing it across a power line, is that the in-rush current it draws may be as high as 700% of the normal rated current. However, in the present invention, this apparent problem is overcome because the power source, the secondary engine 49 and hence the auxiliary power unit generator 48 is power limited and also current limited. The present invention relies on the current limiting feature of the secondary engine 49 and the auxiliary power unit generator 48 to maintain a reasonable or manageable level of surge. This means that high in-rush currents will be suppressed right at the source, i.e. by the secondary engine 49 and the auxiliary power unit generator 48, and therefore not have a substantial effect on the primary generator 22. The present invention does not use a combined PMG and inductor motor for initial spin up of the primary generator.

Another important consideration when using the primary generator 22 as an induction motor is to ensure that the rectifier assembly 43 connected across the main field 38 is protected from high voltages and voltage spikes which will occur in the main field 38 due to transformer action during a start mode. Protection of the rectifier assembly 43 is accomplished by providing means 68 for controllably coupling the rectifier assembly 43 and the main generator field 38. As shown in FIG. 1, the controllably coupling means 68 is shown as a field shorting switch 68. During a start mode, the field shorting switch 68 controllably uncouples the rectifier assembly 43 from the main generator field 38.

A variety of devices are known which may be used to achieve this enabling/disabling, controllably coupling function. The variety of devices include centrifugally activated mechanical devices which employ counterweights, as well as solid-state high powered devices. A novel construction of the switch means 68 is shown in a co-pending patent application to the inventor of the present invention titled "Miniature, Modular, Plug-in Rotating Switch", and filed on Aug. 14, 1992 using the "Express Mail" procedure. At the date of filing the present application the co-pending application has not received a serial number. The co-pending application is hereby incorporated by reference in this application.

The present invention includes a method of starting the primary engine 23 using the dynamoelectric device 20. The method includes disabling the field shorting switch 68 for uncoupling the rectifier assembly 43 from the main generator field 38. By controllably uncoupling the rectifier assembly 43 from the main field 38 during the start-up cycle of the primary engine 23, the rectifier assembly 43 is protected from high voltages and voltage spikes. Next, the start contactor 50 is enabled to couple the primary generator 22 with the auxiliary power unit generator 48 via the AC circuit 55. Next, power is routed through the AC circuit 55 for motorizing the primary generator 22. It can be seen, in keeping with the simplicity of the present invention, the only action which is required to start the primary engine 23 is to enable the start contactor 50. As shown in FIG. 2, the start contactor 50 is enabled by closing the circuit 55. The field shorting switch 68 is normally closed and thereby does not require an action to enable or disable it during the start-up cycle.

Once the primary engine 23 is started and achieves a predetermined condition, such as a predetermined idling speed, the start contactor 50 is opened and the regulator 32 begins exciting the exciter generator field 34 of the generator over the DC circuit 56. Because the start contactor 50 is open during the generation mode, the power produced by the auxiliary power unit generator 48 and the primary generator 22 must now pass through output rectifiers before it is used by the load 46.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A brushless dynamoelectric apparatus in combination with a 270 volt DC system, said brushless dynamoelectric apparatus being operable as both a synchronous alternating current generator for generating electricity and as an induction motor for starting an operatively associated primary engine, said brushless dynamoelectric apparatus comprising:

a main generator having a main generator field and a main generator armature, said main generator armature being wound with two groups of wye-connected three phases for reducing direct current distortion;

an exciter generator having a exciter armature and an exciter generator field;

a rectifier assembly coupled to said exciter armature;

means for selectively coupling said rectifier assembly to said main generator field during a generating mode and uncoupling said rectifier assembly from said main generator field during a start-up mode of the operatively associated primary engine for protecting said rectifier assembly from high voltages and voltage spikes;

a power and current limited auxiliary power unit-driven generator operatively associated with a secondary engine, said auxiliary power unit-driven generator suppresses high in-rush currents, said auxiliary power unit-driven generator having an alternating current output selectively coupled to said main generator for supplying alternating current to said main generator during a start-up mode;

a first alternating current terminal block coupled to said auxiliary power unit-driven generator;

a second alternating current terminal block coupled to said main generator;

a first direct current terminal block coupled to said auxiliary power unit generator;

a second direct current terminal block coupled to said main generator;

said first direct current terminal block being coupled to said second direct current terminal block;

a start contactor coupled between said auxiliary power unit-driven generator and said main generator, said start contactor being coupled between said first alternating current terminal block and said second alternating current terminal block, said start contactor selectively coupling said auxiliary power unit-driven generator to said main generator during a start-up mode of the operatively associated primary engine and uncoupling said auxiliary power unit generator from said main generator during a generating mode.

2. A method of starting a primary engine in a 270 volt DC system using a brushless dynamoelectric apparatus operable both as a generator and as an induction motor, said brushless dynamoelectric apparatus including a main generator having a main generator field and a main generator armature; and exciter generator having an exciter armature and an exciter field; a rectifier assembly coupled between said exciter armature and said main generator field; an auxiliary power unit-driven generator; and a start contactor coupled between said main generator and said auxiliary power unit-driven generator; said method comprising the steps of:

uncoupling said rectifier assembly from said main generator field during a start-up mode of an operatively associated primary engine for protecting said rectifier assembly from high voltages and voltage spikes;

coupling said main generator and said auxiliary power unit-driven generator through an alternating current circuit; and routing power from said auxiliary power unit-driven generator to said main generator through said alternating current circuit for motorizing said main generator as an induction motor.

3. A method of starting a primary engine using a dynamoelectric apparatus as recited in claim 2, further including the step of:

routing alternating current from said auxiliary power unit-driven generator through a first alternating current terminal block coupled to said auxiliary power unit to a second alternating current terminal block coupled to said main generator.

4. A method of staring a primary engine using a brushless dynamoelectric apparatus as recited in claim 2, said method further including the step of:

uncoupling said auxiliary power unit-driven generator from said main generator after starting an associated primary engine and achieving a predetermined idle speed in said main generator;

exciting said exciter generator field of said dynamoelectric apparatus; and coupling said rectifiers to said main generator field for initiating power generation by an operatively associated primary engine.

* * * * *